United States Patent [19]

Fukushima

[11] 4,033,080

[45] July 5, 1977

[54] CONCRETE POLE TO BE CONNECTED WITH A WOOD POLE AND METHOD OF REPLACING THE LOWER PART OF THE WOOD POLE WITH THE CONCRETE POLE

[75] Inventor: Yoshikiyo Fukushima, Tokyo, Japan

[73] Assignee: Nippon Concrete Industries Co. Ltd., Tokyo, Japan

[22] Filed: Jan. 20, 1976

[21] Appl. No.: 650,664

[52] U.S. Cl. ..... 52/223 R; 52/298; 52/514; 52/722; 61/53; 29/401 D

[51] Int. Cl.[2] ..... E04C 3/34; E02D 5/22; B23P 7/00

[58] Field of Search ..... 52/224, 296, 297, 302, 52/303, 514, 722, 298, 725, 223; 214/2.5, 3; 61/53, 56, 54; 29/401

[56] References Cited

UNITED STATES PATENTS

| | | | |
|---|---|---|---|
| 890,373 | 6/1908 | Orr | 52/296 |
| 1,095,197 | 5/1914 | Entenmann | 52/297 |
| 1,431,799 | 10/1922 | Hinckley | 52/722 |
| 1,463,715 | 7/1923 | Muhlow | 52/303 |
| 1,555,945 | 10/1925 | Cuttle et al. | 52/302 |
| 1,589,528 | 6/1926 | Hayes | 52/296 |
| 2,011,018 | 8/1935 | Smith | 52/224 |
| 2,706,498 | 4/1955 | Upson | 52/224 |
| 3,112,830 | 12/1963 | Podlesak | 214/3 |
| 3,333,717 | 8/1967 | Scaperotto | 214/3 |

*Primary Examiner*—James L. Ridgill, Jr.
*Attorney, Agent, or Firm*—Fidelman, Wolffe & Waldron

[57] ABSTRACT

This invention relates to a concrete pole having a reinforcing band and a cylindrical projection, protruding upward, at the outer periphery of the upper end, and a method of replacing the lower part of a wood pole with the said concrete pole. In order to replace the lower part of a wood pole, the lower part is first cut away from the upper part of the wood pole in use, and pulled out of the ground. Subsequently, the concrete pole is driven instead of the removed lower wood pole. Thereafter, the lower end of the upper wood pole is inserted into the cylindrical projection so as to be integrally connected with the concrete pole.

4 Claims, 5 Drawing Figures

CONCRETE POLE TO BE CONNECTED WITH A WOOD POLE AND METHOD OF REPLACING THE LOWER PART OF THE WOOD POLE WITH THE CONCRETE POLE

SUMMARY OF THE INVENTION

This invention relates to a concrete pole to be connected with a wood pole and a method of replacing the lower part of a wood pole with the concrete pole.

Hitherto wood poles have been used for supporting electric wires for reasons that they are easy to manufacture. However wood poles are inferior to concrete poles in durability. Especially wood poles under the ground and around the ground surface become weak earlier than concrete poles by corrosion or the like.

When only the lower part of a wood pole is weak and the upper part thereof is still durable, if the whole of the wood pole is replaced with a new one, it is undesirable in economical respect. Even if only the lower part is replaced, it is not necessarily economical under the circumstance that resources are insufficient at present. Moreover, the replacing operation has caused power failure.

The first object of the present invention is to provide an anticorrosive concrete pole to be connected with the lower end of a wood pole.

The second object of the present invention is to provide a relatively simple method of replacing the lower part of a wood pole, in use, with the said concrete pole.

The third object of the present invention is to provide a method of replacing the lower part of a wood pole without causing power failure.

Other objects and the feature of the present invention will be apparent from the following detailed description.

DETAILED DESCRIPTION OF THE INVENTION

Figure 1:
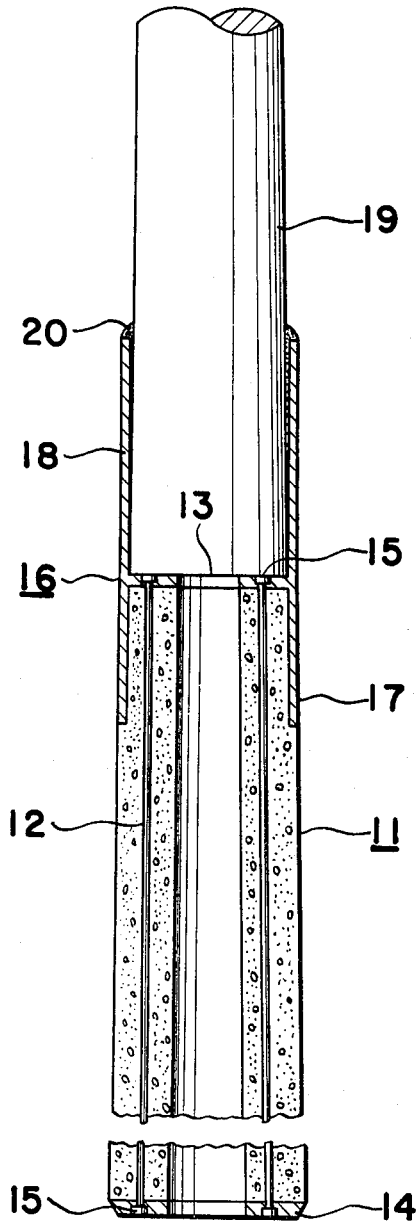
FIG. 1 is a sectional elevation view showing the connected part of the concrete pole of the present invention with a wood pole.
Figure 2A:
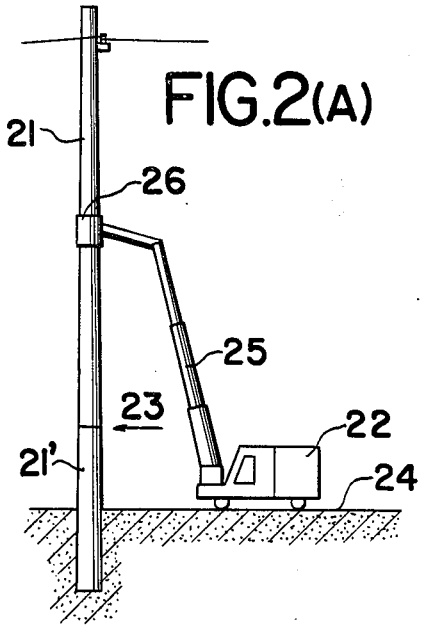
FIGS. 2 (A), 2 (B), 2 (C) and 2 (D) are side elevation views showing how the lower part of a wood pole is replaced with the concrete pole of the present invention.
Figure 2B:
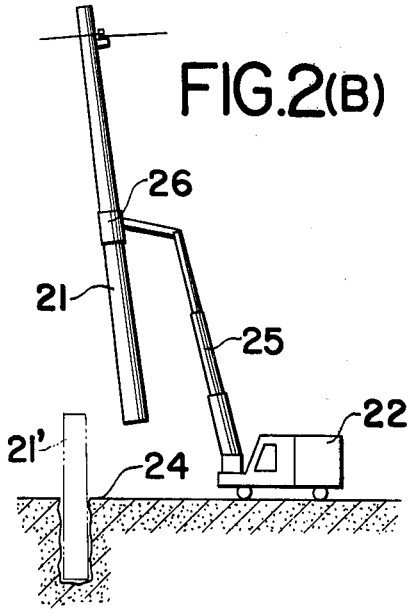
Figure 2C:
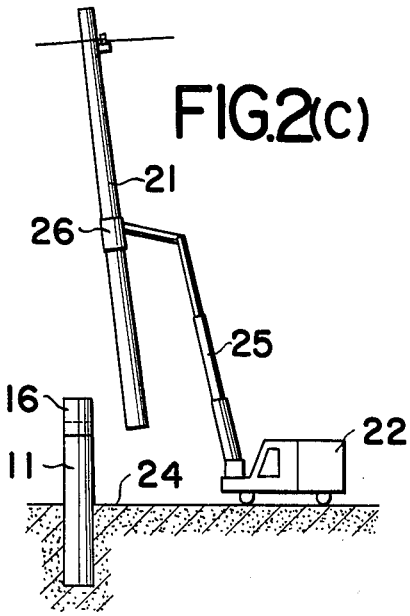
Figure 2D:
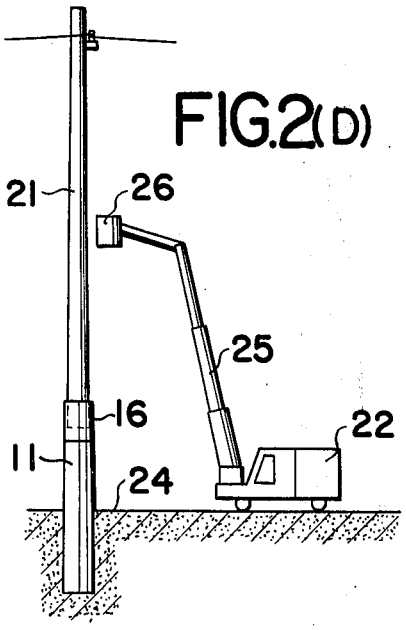

FIG.1 is a sectional elevation view of the concrete pole of the present invention connected with a wood pole. Reference numeral 11 designates a hollow concrete pole in which a suitable number of iron bars 12 are disposed at a certain pitch. 13 and 14 designate end metal plates respectively fixed to the top and the bottom of the concrete pole 11. The end metal plates have holes formed at the pitch corresponding to that of the iron bars 12. The iron bars 12 are inserted through the holes and thereafter rivet heads 15 are formed so that the iron bars 12 are fixed.

Reference numeral 16 designates a steel tube consisting of a reinforcing band 17 attached to the outer periphery of the upper end of the concrete pole 11 and a cylindrical projection 18 protruding upward. The upper end metal plate 13 is integrally formed with them.

Reference numeral 19 designates a wood pole to be integrally connected with the concrete pole 11 in such a manner that the lower end of the wood pole 19 is inserted into the projection 18. In the space between the wood pole 19 and the projection 18, a fixing agent or a binding agent 20 is put, and it is used also for preventing water from entering. The integral connection of the wood pole 19 and the tube 16 can be performed by means of a band or bolts as well as the fixing agent 20.

The abovedescribed concrete pole 11 with the tube 16 can be manufactured by a method similar to that of manufacturing a normal prestressed concrete pole or a reinforced concrete pole. The cylindrical projection 18 can be previously formed integrally with the reinforcing band 17 and the end metal plate 13 at the top of the concrete pole 11. If the concrete pole 11 is connected with the bottom of the wood pole 19, a pole, the upper part of which is made of wood and the lower part of which is made of concrete, is obtained. Such a pole is superior in durability and cheap.

FIGS. 2 (A) to 2 (D) show how only the lower part of a wood pole is replaced with the concrete pole of the present invention. In FIG. 2 (A), the upper part of the wood pole 21 in use is held by a crane installed on the truck 22, and the wood pole 21 is cut at the position of a suitable height, as indicated by the arrow 23. In FIG. 2 (B), the upper part of the wood pole 21 is moved apart from the lower part thereof, and the remaining lower wood pole 21' is pulled out of the ground 24. Reference numeral 25 designates a crane arm, which can freely extend, contract and turn, and reference numeral 26 designates a pole holder provided at the forward end of the said crane arm 25. The pole holder 26 can freely open and close by means of an oil-pressure cylinder.

In FIG. 2 (C), the concrete pole 11 shown in FIG. 1 is driven into the ground instead of the removed lower wood pole 21'. After the concrete pole 11 is driven, the soil around the pole is made hard, and the concrete pole 11 is fixed in the ground by some optional means.

In FIG. 2 (D), the lower end of the upper wood pole 21 is inserted into the projection 18 of the concrete pole 11 as described in accordance with FIG. 1. When the pole holder 26 is removed from the wood pole 21, the replacing operation finishes.

In the embodiment shown in FIG. 1, the present invention has been described with respect to a prestressed concrete pole. However, the concrete pole of the present invention may be a reinforced one.

When the lower part of a wood pole is weakened by corrosion or the like, if only the lower part is replaced, the wood pole can be further used for a long time, i.e., while the upper part thereof is durable. Moreover, in comparison with the replacing of the whole of the wood pole, the replacing operation is simple and it is performed very cheap.

According to the present method, it is not necessary to remove electric wires from wood poles. Therefore, the replacing operation can be performed without causing power failure.

I claim:

1. A means for connecting a round concrete pole to a second pole comprising:

a concrete pole;

a cylindrical metal connecting tube, one end of said connecting tube telescoped over one end of said concrete pole;

a first metal plate within said connecting tube and integral therewith, the flat surfaces of said first plate transverse to the longitudinal axis of said connecting tube, said first metal plate positioned against said pole end, the contiguous surfaces of said concrete pole and said connecting tube being integral by the process of molding said concrete within said connecting tube;

a second circular plate at the other end of said concrete pole;

headed bolts with nuts extending through said concrete between said first and said second plates to compress said concrete pole between said plates; and the other end of said connecting tube being open to receive said second pole.

2. A concrete pole to be connected with a second pole, as claimed in claim 1, in which a prestressed concrete pole or a reinforced concrete pole is used as the said concrete pole.

3. The means of claim 1 further comprising a second pole nested within said other end of said connecting tube, and a binding agent between the surfaces of said second pole and said connecting tube whereby said second pole is made integral with said concrete pole and water is excluded from said connection.

4. The means of claim 1 wherein said second pole is made of wood.

* * * * *